United States Patent [19]

Penninga et al.

[11] Patent Number: 4,992,697

[45] Date of Patent: Feb. 12, 1991

[54] PICTURE DISPLAY DEVICE WITH MAGNETIZABLE CORE MEANS COMPRISING COMPENSATION COILS

[75] Inventors: Johannes Penninga; Albertus A. S. Sluyterman; Bernardus H. J. Dekkers, all of Eindhoven, Netherlands

[73] Assignee: U.S. Philips Corporation, New York, N.Y.

[21] Appl. No.: 302,170

[22] Filed: Jan. 25, 1989

[30] Foreign Application Priority Data

| | | | |
|---|---|---|---|
| Feb. 1, 1988 | [NL] | Netherlands | 8800235 |
| Mar. 3, 1988 | [NL] | Netherlands | 8800540 |
| Apr. 7, 1988 | [NL] | Netherlands | 8800884 |

[51] Int. Cl.[5] ..... H01J 29/76

[52] U.S. Cl. ..... 313/440; 315/8

[58] Field of Search ..... 313/440; 315/8, 85

[56] References Cited

U.S. PATENT DOCUMENTS

| | | | |
|---|---|---|---|
| 2,921,226 | 1/1960 | Vasilevskis | 313/408 X |
| 3,424,942 | 1/1969 | Barbin | 313/440 X |
| 4,853,588 | 8/1989 | Ohtsu et al. | 313/440 |

FOREIGN PATENT DOCUMENTS

| | | | |
|---|---|---|---|
| 0220777 | 5/1987 | European Pat. Off. . | |
| 00944 | 1/1988 | Japan | 313/440 |
| 76245 | 4/1988 | Japan | 313/440 |

*Primary Examiner*—Palmer C. DeMeo

*Attorney, Agent, or Firm*—Bernard Tiegerman

[57] ABSTRACT

Deflection unit mounted around a display tube for deflecting electron beams across the display screen includes a line deflection coil and a field deflection coil. A compensation coil system for generating a magnetic compensation field oppositely directed to the line frequency radiation field in a space in front of the display screen includes core means of a magnetizable material positioned between the display screen and the deflection unit in a plane parallel to the display screen and two diametrically arranged coils each having at least one turn.

15 Claims, 5 Drawing Sheets

PICTURE DISPLAY DEVICE WITH MAGNETIZABLE CORE MEANS COMPRISING COMPENSATION COILS

BACKGROUND OF THE INVENTION

The invention relates to a picture display device having a display tube whose rear portion has of a cylindrical neck accommodating a device for generating electron beams and whose front portion is funnel-shaped, the widest portion being present on the front side and having a phosphor display screen. The display device also has an electro-magnetic deflection unit mounted around a part of the display tube for deflecting electron beams across the display screen, the unit including a line deflection coil having two line deflection coil halves arranged on either side of a plane of symmetry and a field deflection coil and a compensation coil system for generating a magnetic compensation field which is oppositely directed to the line frequency radiation field in a space in front of the display screen.

EP-A 220,777 discloses such a display device having means for compensating stray fields produced by the line deflection coil.

Recently more stringent standards have been introduced for certain types of picture display devices, notably for monitors, with respect to the magnetic interference field which they may produce around them. An important source of magnetic interference fields is the line deflection coil because it is operated at radio frequency currents (frequencies in the range of 10 to 100 kHz) as contrasted to the field deflection coil. It is impossible to design a satisfactorily operating deflection coil which does not produce a stray field. If the stray field were to be eliminated by means of a protective shield, such a shield would only be effective if the combination of display tube and deflection unit were also shielded on the display screen side. It is true that the external magnetic field of a deflection unit is not very strong; at a distance of 50 cm from the front side of a deflection unit for a 110° monochrome display tube the field strength has already decreased to approximately 1% of the strength of the earth's magnetic field, but it is the variation of the field with respect to time which is important. Field variations may cause interferences in other electronic apparatus, and research is being done to establish whether human health is affected by these fields. Nowadays the time derivative of the field of the deflection unit increases with the increase of the line frequencies and hence with increasingly shorter fly back periods.

For compensating the line deflection stray field the use of a compensation coil system which, when energized, generates a compensating magnetic dipole field is described in the above-mentioned Patent publication. This dipole field can be obtained by energizing one coil whose turns are mainly located in one flat plane (a "current loop"), which coil has the correct number of turns, the correct surface area and the correct orientation. Energization may be effected, for example, by arranging the compensation coil in series with or parallel to the line deflection coil. The compensation field may be obtained alternatively by energizing two "current loops" which are positioned on either side of the line deflection coil, which current loops have the correct number of turns, the correct surface area and the correct orientation. Also in this case energization may be effected, for example, by arranging the compensation coils constituted by the current loops in series with or parallel to the line deflection coil.

The compensation coils are preferably large so as to reduce their energy content.

However, a problem is that many types of display devices (particularly monitors) lack the space to accommodate large coil systems in their correct position. Consequently, relatively small (too small) compensation coils must be used so that the radiation compensation consumes much (line deflection) energy. Moreover, the sensitivity of the line deflection coil is detrimentally influenced if the compensation coil system is arranged in series with the line deflection coil. The induction then increases.

SUMMARY OF THE INVENTION

The invention has for its object to provide measures enabling a compensation of the radiation field of the line deflection coil with less energy and less sensitivity loss than is realized by the known measures.

The compensation coil system has core means of a magnetizable material which is positioned between the display screen and the deflection unit in a plane parallel to the display screen and which has two diametrically arranged coils each comprising at least one turn. (The turns are then generally located in planes which are transverse to the display screen).

The simplicity of this solution for radiation compensation which is based on the use of a core means of a magnetizable material provided with a set of toroidal coils or a set of saddle coils at least partly surrounding the core means is superior to all known solutions to this problem, which solutions are based on the use of coreless, i.e. air-cored coils. A coil surrounding a core of a magnetizable material occupies little space and its loss of sensitivity is extremely small, in a given case, for example, 5× less than in a known solution using one air-cored coil above the deflection unit and one air-cored coil below it.

Toroidal coils are understood to be coils wound around (a part of) the core means. In one embodiment of the invention they are arranged proximate to locations where the plane of symmetry of the line deflection coils intersects the display tube. Saddle coils are understood to be coils arranged on a core portion of the core means. In one embodiment of the invention they are arranged on either side of the plane of symmetry of the line deflection coils.

In a preferred embodiment the core means has one single closed annular core which is arranged parallel to the display screen and surrounds the display tube at a position in front of the deflection unit. The use of a closed annular core surrounding the tube and comprising two (saddle or toroidal) coils has the advantage of a great sensitivity.

An alternative possibility is the use of a core means having a separate core portion, for example, an annular segment or a rod element for each (toroidal) coil, which may be advantageous when winding and mounting the coils.

The core portions are particularly arranged in such a manner that they intersect the plane of symmetry of the line deflection coil. In one embodiment the core portions are arranged on either side of the funnel-shaped portion of the display tube, symmetrically with respect to the plane through the tube axis which is perpendicular to the plane of symmetry of the line deflection coil.

Rod-shaped core portions have proved to be very suitable in practice. The length of the rod-shaped core portions is preferably at least equal to the largest cross-section of the line deflection coil. For the purpose of landing error correction permanent magnets may be arranged at opposite ends of the rod-shaped core portions.

The rod-shaped core portions are preferably to be wound with coils in such a way that a magnetic field which is as symmetrical as possible is generated when energizing the coils. There are a different alternatives for this purpose.

A first embodiment is characterized in that the core portions are provided with coils having a coil-winding pattern comprising an upwardly going winding and a downwardly going winding crossing each other.

A second embodiment is characterized in that the core portions are provided with coils having turns whose turn planes are at east substantially parallel to the plane of symmetry of the line deflection coil, the turns being interconnected by means of wire pieces extending parallel to the axis of the core portions.

If the core means has an annular core and particularly if a separate annular segment is used for each (toroidal) coil, it is important for a favourable operation that the projection of the annular core or of the segments on the plane of symmetry of the line deflection coil has a dimension parallel to the display screen which is larger than the dimension perpendicular to the display screen.

A further important aspect is that the annular core and the core portions with the associated coils can be positioned as favourably as possible.

Due to the positioning at a certain distance in front of the deflection unit it can be achieved that the (magnetizable) annular core and the core portions capture a minimal quantity of magnetic flux from the line deflection coil. On the one hand this implies that there is no shielding effect (therefore, the invention is not based on this recognition) but on the other hand there is neither any substantial influence on the line deflection field and, notably, there are substantially no side effects on convergence and raster. If the compensation coils are of the saddle type, the side effect on landing is also found to be minimal.

Within the scope of the invention it is possible to arrange the magnetizable annular core and the core portions with the associated coils in such an axial position that the coils are located in a plane at least substantially comprising the imaginary radiation centre of the line deflection coil. This means that the imaginary radiation centre of the compensation coil system then at least substantially coincides with the imaginary radiation centre of the deflection unit. Due to the fact that the diameter of the line deflection coil and the yoke ring surrounding it increases towards the display screen, the radiation centre of the deflection unit does not coincide with its mechanical centre but is located at a short distance (several centimetres) in front of the deflection unit (in the display tube). This means that the known solutions do not provide the possibility of positioning the compensation coil or coils in such a way that the radiation centre of the compensation coil system coincides with the radiation centre of the deflection unit. The generation of the compensation (dipole) field is consequently accompanied by the generation of a higher order magnetic field (four-pole field, six-pole field, dependent on the configuration chosen). Generally it is necessary to compensate for this higher order field in its turn so as to comply with the requirements imposed. An additional compensation coil system is then required. This problem does not present itself in the device according to the invention because it is possible to position the annular core and the core portions of magnetizable material with the associated compensation coils in such a way that the radiation centre of the compensation coil system at least substantially coincides with the radiation centre of the deflection unit.

A practical method of connecting the compensation coil system according to the invention is obtained in a device which is characterized in that the coils have the same winding direction and, in operation, are adapted to be connected to a line frequency current source in such a way that the fields which they generate have the same direction.

FIG. 1*a* is a perspective elevational view of a picture display device comprising a display tube provided with an electromagnetic deflection unit having a compensation coil system;

FIG. 1*b* shows diagrammatically the line deflection coil of the electro-magnetic deflection unit with the compensation coil system of FIG. 1*a;*

FIG. 2*a* is a diagrammatic rear view of a display tube on which a compensation coil system according to the invention is arranged;

FIG. 2*b* is a diagrammatic longitudinal section of a coiltube combination provided with a compensation coil system according to the invention;

FIG. 3 is a diagrammatic longitudinal section of a tubecoil combination provided with a conventional compensation coil arrangement;

FIGS. 4*a*, 4*b* and 5 show toroidal compensation coil arrangements according to the invention;

DETAILED DESCRIPTION OF THE PREFERRED EMBODIMENTS

Figure 1A:
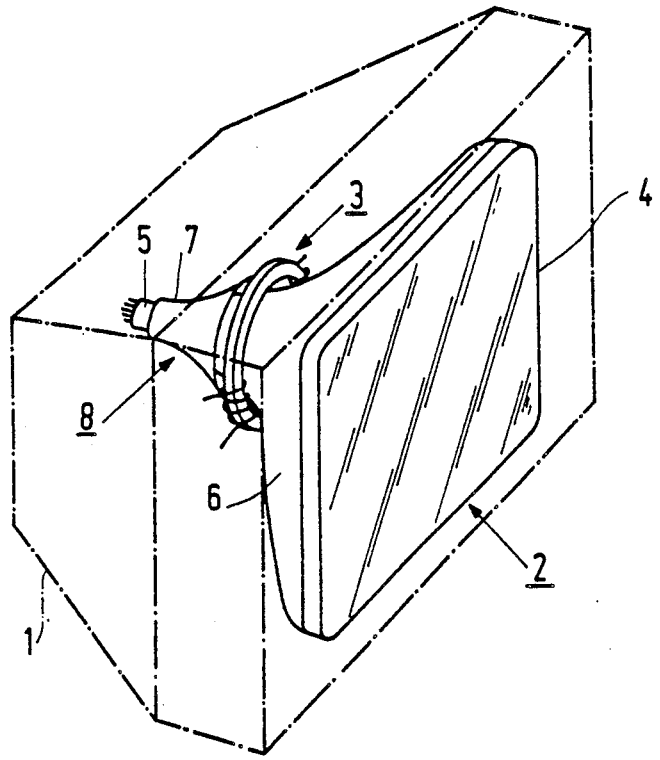

FIG. 1*a* is a perspective elevational view of a combination of a deflection unit and a display tube, which is placed in a cabinet 1 and comprises a compensation coil system 3 according to the invention. For the sake of clarity all details which are unimportant for understanding the invention have been omitted.

The display tube 1 has a cylindrical neck 5 and a funnel-shaped portion 6 the widest portion of which is present on the front side of the tube and which comprises a display screen (not shown).

The display screen comprises phosphors which upon impingement by electrons luminesce in a predetermined colour. The rear portion of the neck 5 accommodates an electron gun system 7 (shown diagrammatically). At the area of the transition between the neck 5 and the funnel-shaped portion 6 an electro-magnetic deflection unit 8 diagrammatically shown is arranged on the tube, which unit comprises, inter alia, a line deflection coil 9*a*, 9*b* (FIG. 1*b*) for deflecting the electron beams in the horizontal direction x. As is shown diagrammatically in FIG. 1*b*, the line deflection coil 9*a*, 9*b* generally comprises two saddle-shaped coil halves which are arranged on either side of a plane of symmetry (the x-z plane). In the operating condition a sawtooth current having a frequency of between 10 and 100 kHz, for example a frequency of approximately 64 kHz, is passed trough these coil halves. Generally the line deflection coil 9*a*, 9*b* is surrounded by an annular element 10 of a soft-magnetic material, the so-called yoke ring, which is also shown diagrammatically in FIG. 1*b*.

When the radiation field of a line deflection coil having a yoke ring is initially equally large but opposed to that of a coil without a yoke ring, the line deflection coil can be assumed for large distances to be a current loop having a given magnetic moment.

The field $B_o$ in the radiation centre of a line deflection coil without a yoke ring can be calculated to be approximately 30 Gauss. The field of a practical deflection coil having a yoke ring has approximately twice this value.

Figure 3:
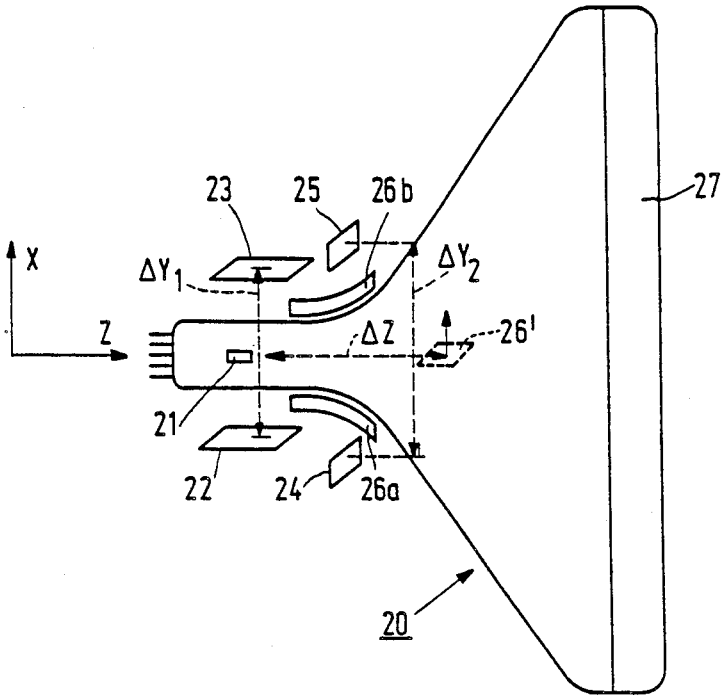
FIG.3 PRIOR ART

FIG. 3 shows how this radiation field is compensated when using a conventional solution.

FIG. 3 shows diagrammatically a display tube 20 comprising an electron gun 21 arranged at the end of the neck and a display screen 27 arranged at the front. A deflection unit in which only the line deflection coil 26*a*, 26*b* is shown diagrammatically, is arranged on the outer surface of the display tube 20.

FIG. 3 also shows a deflection unit comprising two sets of compensation coils, a horizontally positioned set 22, 23 for mainly generating a dipole compensation field and a vertically positioned set 24, 25 for mainly generating a four-pole compensation field. By choosing the number of turns of the vertical set to be different from those of the horizontal set and by choosing both the correct current directions and the correct sizes of the horizontal and vertical sets, a considerable field reduction at distances from approximately 50 cm can be realized. With regard to the correct choice of the current directions this notably means that upon energization of the interference suppression coil system the currents in the horizontal portions flow in the same direction as the currents in the corresponding (axial) portions of the line deflection coils and that the currents in the vertical portions flow in a direction which is opposite to the direction of the corresponding (transversal) portions of the line deflection coils.

The coil arrangement of FIG. 3 operates as follows. The interfering field of a line deflection coil 26*a*, 26*b* may be roughly considered to be a dipole in the tube 20 (=current loop 26'). in other words: since the diameter of the line deflection coil 26*a*, 26*b* increases towards the display screen 27, the centre of the radiation field of the line deflection coil is located in front of the line deflection coil. The compensation is effected by means of the coils 22 and 23 which are arranged symmetrically relative to the plane of symmetry of the line deflection coil 26*a*, 26*b*. However, a 6-pole component is also produced due to the distance $\Delta Y_1$ between the coils 22 and 23 and a 4-pole component is also produced due to the distance $\Delta Z$. If the coils 22, 23 are moved forwards (in order to reduce $\Delta Z$ and hence the 4-pole component), $\Delta Y_1$ must increase and so does the 6-pole component. If $\Delta Y_1$ is maintained small, the 6-pole component can be slightly reduced by enlarging the diameter of the coils 22 and 23, which, however, results in that $\Delta Z$ must increase because the coils cannot project into the tube Mainly a 4-pole proportional to the size of the coils, the current through the coils and the distance $\Delta Y_2$is generated with the two vertical coils 21 and 25. A good combination of coil sizes and current intensities can neutralize the 4- and 6-poles so that the ultimate exterior effect of the compensation coil arrangement is a dipole field which is oppositely directed to the radiation dipole field of the line deflection coil.

A considerable drawback thus is that the radiation centre of the conventional compensation coil arrangement, both along the y axis and along the z axis, does not coincide with the (imaginary) radiation centre of the line deflection coil.

Figure 1B:
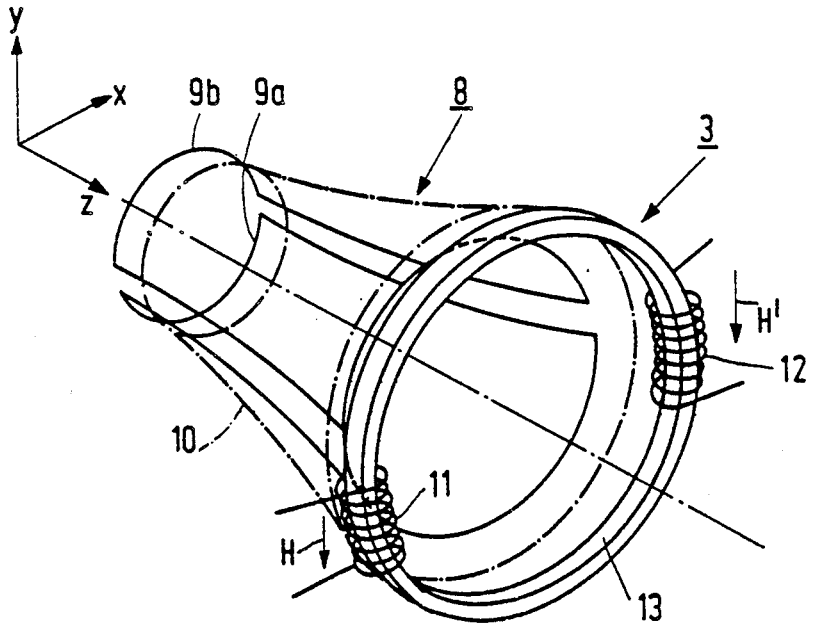
Figure 2A:
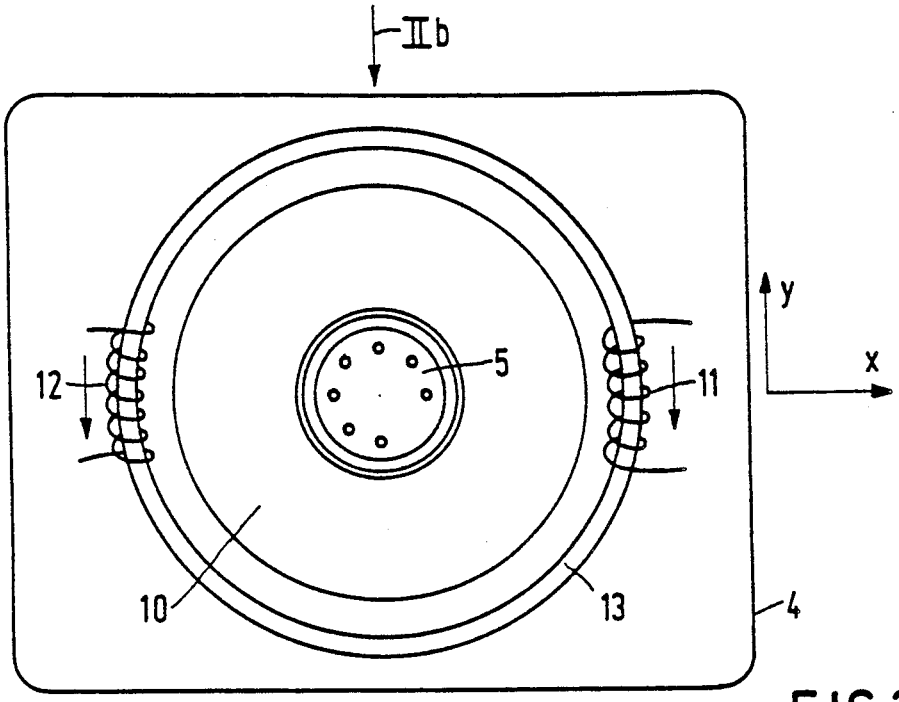
Figure 2B:
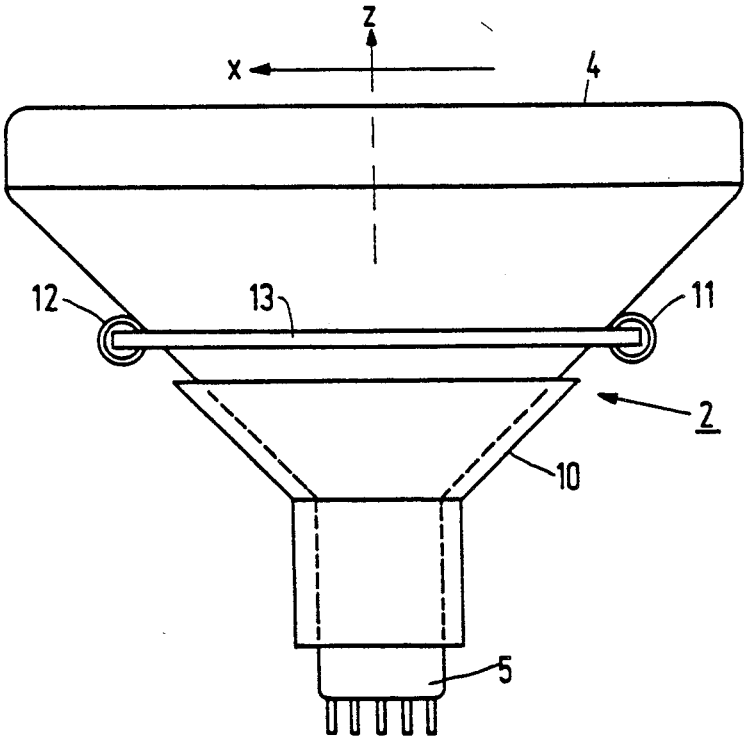

The present invention recognizes this drawback, which has led to the design of a completely novel compensation coil arrangement. In one embodiment of this arrangement two compensation coils 11, 12 are used which comprise a core means 13 of a magnetizable material (FIGS. 1*b*, 2*a*, 2*b*). In the arrangement shown in FIG. 1*b* the coils 11, 12, each of which requires only a few turns (for example, fewer than 10), are toroidally wound on one single annular core 13, but as has been stated hereinbefore, it may be advantageous to use compensation coils of the saddle type. The core 13, which may be made of the same material, for example MnZn ferrite as the annular core of a deflection unit, is arranged at some distance (for example, several cm) in front of the deflection unit 8 with the line deflection coil 9*a*, 9*b* and yoke ring 10 in order to influence the (line) deflection field as little as possible. Preferably, the core 13 must thus not be directly seated on the front-sided conductor portions of the line deflection coil 9*a*, 9*b*. The winding direction and energization of the coils 11, 12 is such that they generate magnetic fields H,H' having the same orientation.

FIG. 2*a* is a rear view and FIG. 2*b* is a plan view of a display tube, like the display tube 2 of FIG. 1, comprising a compensation coil arrangement according to the invention. The core 13 comprising the coils 11 and 12 may be positioned in such a way (in axial directions, or in the z direction) that the radiation centre of the compensation coil system at least substantially coincides with the radiation centre of the line deflection coil.

Figure 4A:
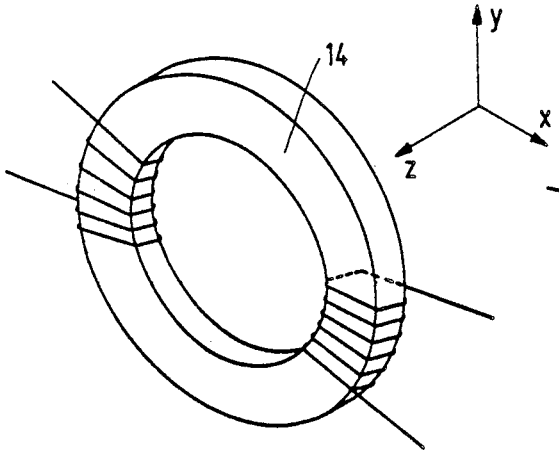
Figure 4B:
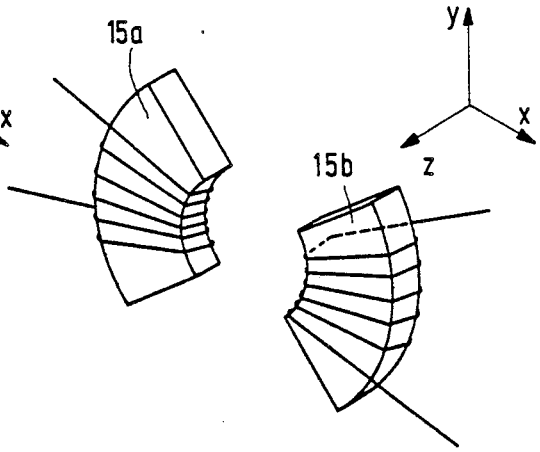

The effect of the compensation coil system according to the invention is improved if the coils are provided with an annular core 14 (FIG. 1*a*) or with annular core segments 15*a*, 15*b* (FIG. 4*b*) which have a dimension in the x direction which is larger than their dimension in the z direction. The use of annular core segments as shown in FIG. 4*b* may facilitate mounting on the cathode ray tube.

Figure 5:
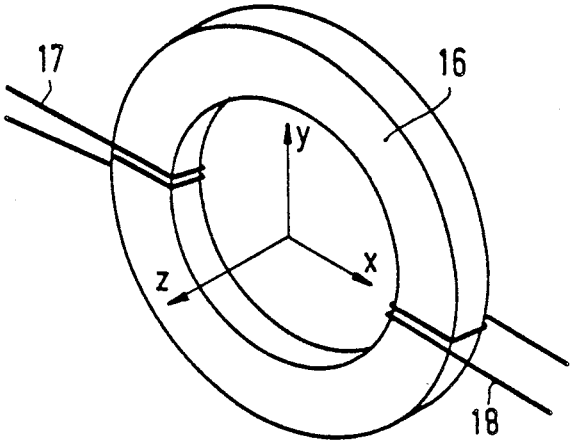
Figure 6:
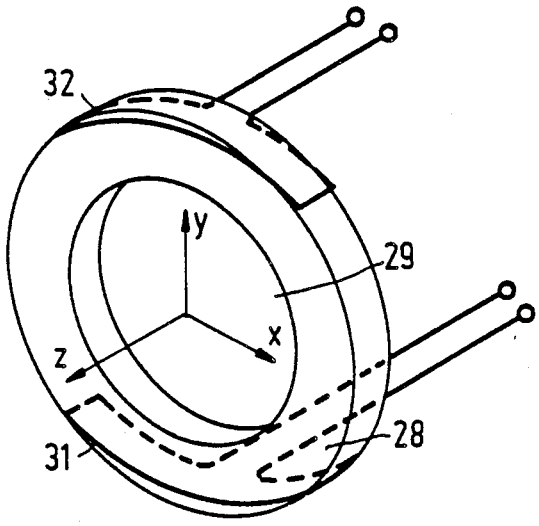
FIG. 6 shows a compensation coil arrangement according to the invention, using saddle coils.
Figure 7:
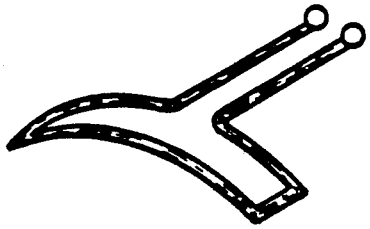
FIG. 7 shows a saddle coil suitable for use in the arrangement of FIG. 6.

FIG. 5 shows an annular core 16 comprising two very flat compensation coils 17, 18 which are located substantially entirely in the x-z plane, the plane of symmetry of the line deflection coils. The turns of the coils 17, 18 are located in planes which are substantially parallel to the x-z plane FIG. 6 shows a core means in the form of a disc-shaped annular core 28 having an aperture 29 and comprising two saddle coils 31, 32 of the type shown in FIG. 7 which are arranged on either side of the x-z plane, the plane of symmetry of the line deflection coils. The turns of the coils 31, 32 are located in planes which are substantially transverse to the display screen parallel to the x-y plane.

Figure 8:
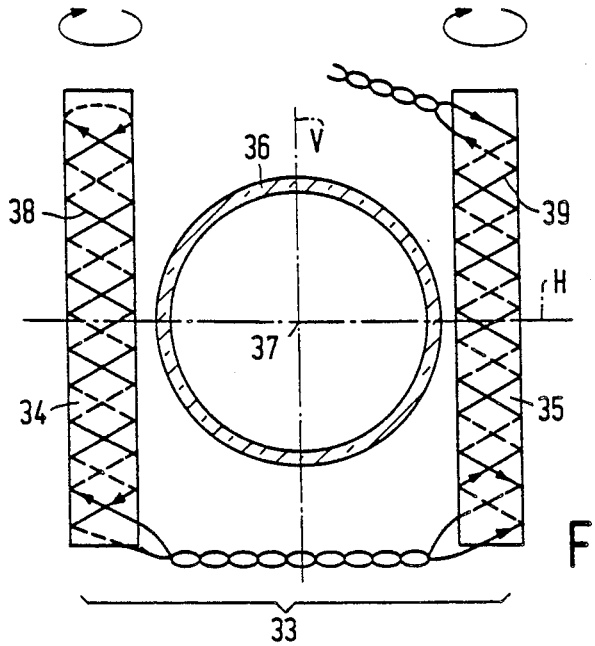
FIGS. 8 and 9 show compensation coil arrangements having rod-shaped core portions wound with coils in a first and a second manner.

FIG. 8 shows a core means 33 comprising two rod-shaped core portions 34, 35 arranged on either side of a funnel-shaped display tube portion 36, symmetrically with respect to a plane V which passes through the axis 37 of the display tube and is perpendicular to the plane of symmetry H of the line deflection coil (not shown).

In a given application the rod-shaped core portions 34, 35 had a length of 120 mm and a diameter of 5 mm and they were made of 4C6 ferrite. Rod lengths of 10 to 20 cm were found to be suitable in practice. Coils 38, 39 having a limited number of turns (in connection with the induction) are arranged on the core portions 34, 35 and extend in this embodiment over the greater part of the length of the core portions 34, 35.

In order that the coils 38, 39 (arranged in series in this embodiment) generate a field which is as symmetrical as possible when they are energized, they have a winding configuration with an upwardly going and a downwardly going winding crossing each other. In a given application each winding had eight turns. Windings having six to ten turns were found to be suitable in practice. In FIG. 8 the turns start and end at the extremities of the core portions but the invention is not limited thereto. A practical method is, for example, winding upwards from the centre, subsequently winding all the way downwards and finally winding upwards to the centre again.

Figure 9:
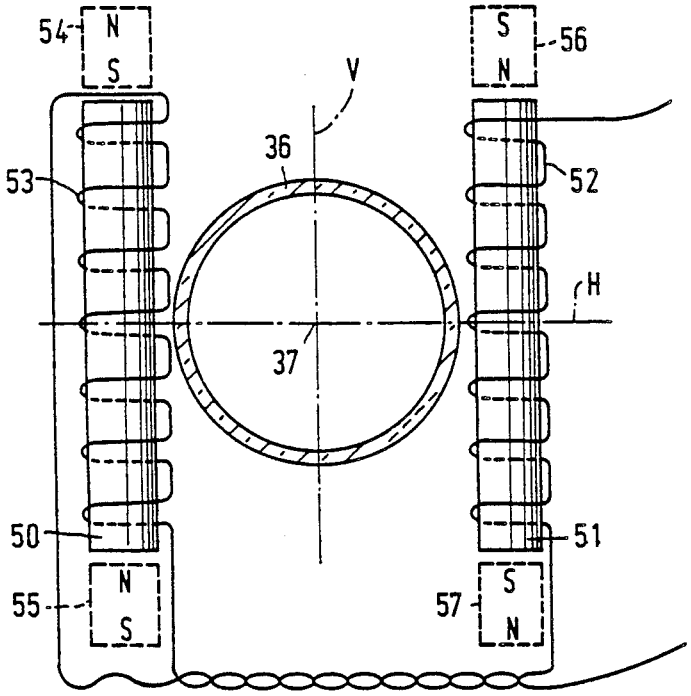

FIG. 9 illustrates an alternative possibility of generating a field which is as symmetrical as possible. The rod-shaped core portions 50, 51 are provided with coils 52, 53 whose turns are substantially parallel to the plane of symmetry H of the line deflection coil (not shown), whilst the turns are interconnected by means of wire pieces which are parallel to the longitudinal axes of the rod-shaped core portions 50, 51.

As is shown in FIG. 9, permanent magnets 54, 55 and 56, 57 may be arranged at opposite ends of the rod-shaped core portions for the purpose of landing error correction.

Figure 10:
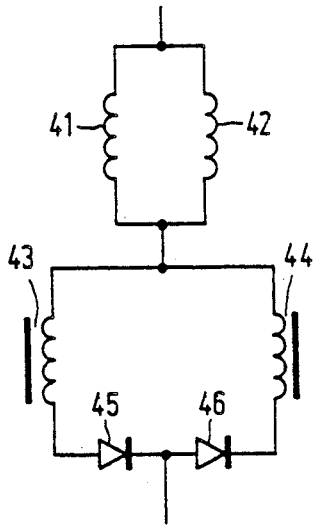
FIG. 10 is an electric circuit diagram for a possible method of connecting the compensation coil system according to the invention.

Another possibility of reducing the influence of landing errors when using compensation coils wound on rod-shaped core portions is the addition of a configuration with two diodes. In principle, the compensation coils are then arranged in parallel, as is shown diagrammatically in FIG. 10, in which two parallel-arranged line deflection coils 41, 42 are connected in series with two parallel-arranged compensation coils 43, 44. Diodes 45, 46 ensure that the line deflection current is mainly passed through the "left-hand" compensation coil 43 when the electron beams are deflected to the "right" on the display screen, and conversely.

What is claimed is:

1. A picture display device having a display tube whose rear portion consists of a cylindrical neck accommodating a device for generating electron beams and whose front portion is funnel-shaped, the widest portion being present on the front side and comprising a phosphor display screen, said display device also comprising an electro-magnetic deflection unit mounted around a part of the display tube for deflecting electron beams across the display screen, said unit comprising a line deflection coil having two line deflection coil halves arranged on either side of a plane of symmetry and a field deflection coil, and a compensation coil system for generating a magnetic compensation field which is oppositely directed to the line frequency radiation field in a space in front of the display screen, characterized in that the compensation coil system includes a core means of magnetizable material which is positioned between the display screen and the deflection unit in a plane parallel to the display screen and which has two diametrically arranged coils each comprising at east one turn, the distance between the compensation coil system and the deflection unit being chosen so that, in operation, the compensation coil system produces a deflection of the electron beams which is insignificant compared to that produced by the deflection unit.

2. A device as claimed in claim 1, characterized in that each of the two coils is of the toroidally wound type arranged proximate to locations where said plane of symmetry intersects the display tube.

3. A device as claimed in claim 1, characterized in that each of the two coils is of the saddle type arranged on a core portion and on either side of said plane of symmetry.

4. A device as claimed in claim 1, characterized in that the core means comprises one single closed annular core which is arranged parallel to the display screen and surrounds the display tube at a position in front of the deflection unit.

5. A device as claimed in claim 2, characterized in that the core means comprises two core portions intersecting the plane of symmetry of the line deflection coil and in that each coil is separately wound around a core portion.

6. A device as claimed in claim 5, characterized in that the core portions are arranged on either side of the funnel-shaped portion of the display tube, symmetrically with respect to the plane through the tube axis which is perpendicular to the plane of symmetry of the line deflection coil.

7. A device as claimed in claim 6, characterized in that the core portions are annular segments.

8. A device as claimed in claim 6, characterized in that the core portions are rod-shaped.

9. A device as claimed in claim 8, characterized in that the core portions are provided with coils having a coil-winding pattern comprising an upwardly going winding and a downwardly going winding crossing each other.

10. A device as claimed in claim 8, characterized in that the core portions are provided with coils having turns whose turn planes are at least substantially parallel to the plane of symmetry of the line deflection coil, said turns being interconnected by means of wire pieces extending parallel to the axis of the core portions.

11. A device as claimed in claim 4, characterized in that the projection of the annular core on the plane of symmetry of the line deflection coil has a dimension parallel to the display screen which is larger than the dimension perpendicular to the display screen.

12. A device as claimed in claim 1, characterized in that the core means is located in a plane at least substantially comprising an imaginary radiation centre of the line deflection coil.

13. A device as claimed in claim 1, characterized in that the coils of the compensation coil system have the same winding direction and, in operation, are adapted to be connected to a line frequency current source in such a way that the fields which they generate have the same direction.

14. A device as claimed in claim 8, characterized in that permanent magnets are arranged at opposite ends of the rod-shaped core portions for the purpose of landing error correction.

15. A device as claimed in claim 8, characterized in that a diode configuration is electrically connected to the coils arranged on the rod-shaped core portions, such that in operation mainly that coil is energized which is remotest from the deflected beams.

* * * * *